United States Patent [19]

Davis

[11] Patent Number: 5,071,124

[45] Date of Patent: Dec. 10, 1991

[54] BADMINTON RACQUET

[75] Inventor: Stephen J. Davis, Yardley, Pa.

[73] Assignee: Prince Manufacturing, Inc, Lawrenceville, N.J.

[21] Appl. No.: 518,136

[22] Filed: May 3, 1990

[51] Int. Cl.[5] ..... A63B 49/02

[52] U.S. Cl. ..... 273/73 G; 273/73 C

[58] Field of Search ..... 273/73 R, 73 C, 73 D, 273/73 G, 73 H, 73 J

[56] References Cited

U.S. PATENT DOCUMENTS

| | | | |
|---|---|---|---|
| 3,647,211 | 3/1972 | Doessel et al. | 273/73 C |
| 4,145,047 | 3/1979 | Nagamoto et al. | 273/73 G X |
| 4,165,071 | 8/1979 | Frolow | 273/73 G X |
| 4,280,699 | 7/1981 | Drake | 273/73 C |
| 4,664,380 | 5/1987 | Kuebler | 273/73 C |

FOREIGN PATENT DOCUMENTS

| | | | |
|---|---|---|---|
| 23826 | 8/1935 | Australia | 273/73 C |
| 605166 | 10/1934 | Fed. Rep. of Germany | 273/73 C |
| 2026327 | 2/1980 | United Kingdom | 273/73 G |

*Primary Examiner*—Edward M. Coven
*Assistant Examiner*—William E. Stoll
*Attorney, Agent, or Firm*—White & Case

[57] ABSTRACT

A badminton racquet includes a head, a shaft, and a Y-joint connecting the head to the shaft. The Y-joint geometry offers improved transmission of stress from the head to the shaft, and the resulting increased length of the center longitudinal strings improves power. Preferably, the frame has an improved aerodynamic profile, and a kick shaft to produce greater head speed at the point of impact.

8 Claims, 3 Drawing Sheets

BADMINTON RACQUET

The present invention is an improved badminton racquet.

Badminton racquets differ from squash and tennis racquets insofar as they are designed to hit a shuttlecock rather than a relatively massive object such as a squash or tennis ball. Badminton racquets are thus intended to make impact at greater head speed than squash or tennis racquets. This requires badminton racquets to have a lighter build, in order to provide a quick response.

Traditionally, badminton racquets are composed of a hoop section, which forms the head and supports strings, a generally round shaft portion carrying a handle, and a T-shaped tubular joint which connects the shaft to the head. In this type of construction, the opposed ends of the head are received in the arms or sleeves of the T-joint, and the shaft is received in the tubular base or stem. Examples of this type of construction are shown in U.S. Pat. Nos. 4,360,202 and 4,568,084.

In a conventional badminton racquet, impact forces from hitting the shuttlecock are transmitted from the head to the shaft through the T-joint connector. Because the sleeves of the T-joint lie at 90 degrees relative to the racquet axis, this means that impact forces are transmitted largely as torsional stresses.

More particularly, when a frame impacts a shuttlecock, the head undergoes deformation which is a combination of bending (perpendicular to the string plane) and angular rotation about the center axis of the racquet (unless the shuttlecock hits exactly along the axis). In a T-jointed frame, this stress is transferred almost solely in torsion in the T-joint area. Head bending is transferred as torsion about the axis of the arms, i.e., perpendicular to the racquet axis, and angular rotation is transmitted as twisting about the racquet axis, i.e., twisting within the stem socket.

As a result, the design of a T-joint in a badminton frame tends to be complicated in that it must resist both types of torsional stress. Generally, a circular shape resists torsion more efficiently than other shapes, and most badminton frames, as a result, tend to be nearly circular in the T-joint area.

SUMMARY OF THE INVENTION

The present invention is a badminton racquet with an improved geometry that retains the weight advantages of a conventional badminton racquet, but which exhibits good strength and improved performance characteristics relative to conventional racquets.

More particularly, the present invention is a badminton racquet which includes a head, a shaft, and a Y-joint connecting the head to the shaft for better stress transmission. Preferably, the frame has an improved aerodynamic cross section, which is thinnest at the top of the head and slightly wider at the Y-joint area. Another preferred feature of the present invention is a kick shaft which is designed to flex about a certain desired location to improve response.

In contrast to conventional T-joint badminton racquets, a racquet according to the present invention employs a Y-joint connecting the head to the shaft, whereby bending and torsion are shared at the joint. By not using 90 degree angles in the joint, the stresses are a combination of bending and torsion and blend into the shaft area through the Y geometry. This enables the racquet to be made with a more aerodynamic shape since a large diameter joint, which would otherwise be desirable to carry the torsional stresses present in a T geometry, is not needed.

Another benefit of the geometry according to the invention is that the center main strings extend further toward the shaft in a Y-joint frame than in a T-joint frame. Due to the longer string length, the main strings provide more power without increasing the overall width of the racquet frame, which would make the frame less maneuverable.

As noted above, preferably the frame is given an aerodynamic cross section in which the width is thinnest at the top of the head, and increases at the Y-joint. In an exemplary embodiment, at the top of head the frame has a width (in the string plane) of 4 mm and a height (perpendicular to the string plane) of 11 mm. The width increases to about 6 mm at the top of the Y-joint, whereas the height tapers to about 9 mm, i.e., the width increases as the height decreases. This produces a relatively elongated cross section at the outer portion of the head, where the forces are primarily bending, and a more rounded shape near the Y-joint for better force transmittal of any rotational torque.

In an exemplary embodiment of a racquet having a kick shaft, the width and height of the shaft taper from the bottom of the Y-joint for a distance toward the bottom of the shaft, to a narrow flex region. Below this flex region, the width and height increase again and remain constant along the region carrying the handle.

The frame may be made from a single frame profile member; alternatively, the head, Y-joint, and shaft may be two separate pieces or three separate pieces. The frame may be made of synthetics (e.g., fiber impregnated resin) or metal, or a combination of different materials, e.g., a metal shaft with a synthetic head or vice versa.

For a better understanding of the invention, reference is made to the following detailed description of a preferred embodiment, taken in conjunction with the drawings accompanying the application.

DETAILED DESCRIPTION OF A PREFERRED EMBODIMENT

Figure 1:
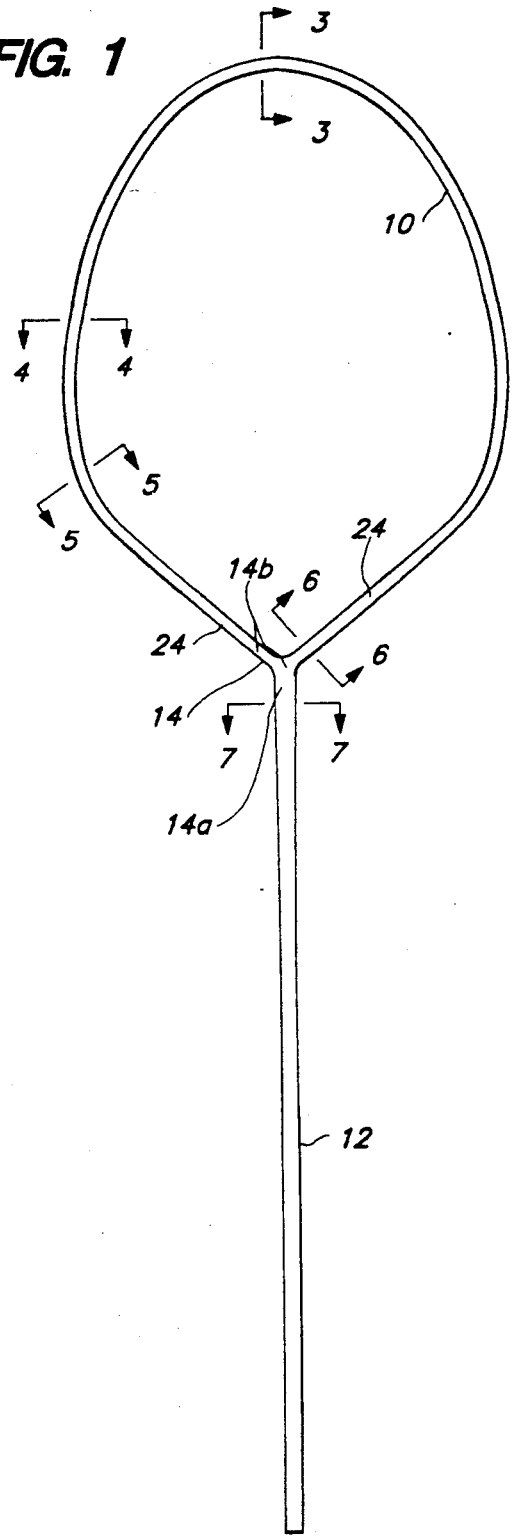
FIG. 1 is a plan view of a badminton frame according to the invention.
Figure 2:
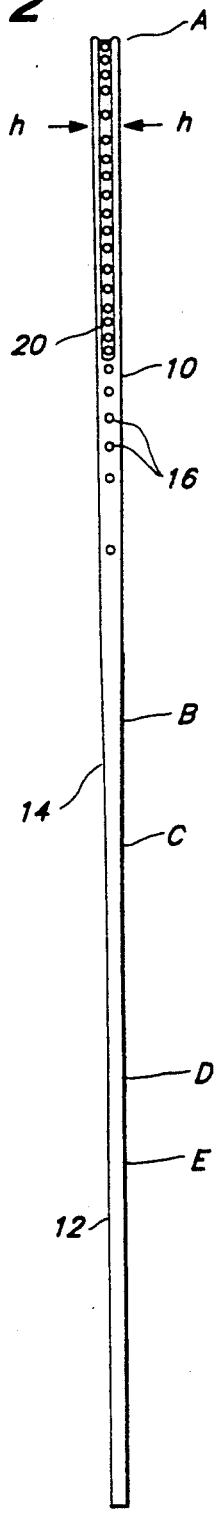
FIG. 2 is a side view of the frame of FIG. 1.
Figure 3:
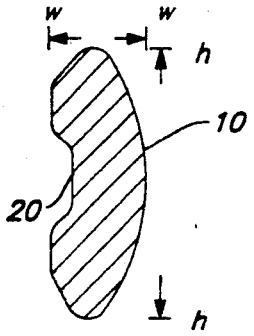
FIGS. 3, 4, 5, 6, and 7 are enlarged sectional views taken through lines 3—3, 4—4, 5—5, 6—6, and 7—7, respectively, of FIG. 1.

FIGS. 1 and 2 show a badminton frame that includes a generally oval head 10, a shaft 12, and a Y-joint 14 that joins the head 10 to the shaft 12. Each member 10, 12, 14 is preferably made of graphite or other fiber-impregnated resin, or of metal, and may be a hollow tubular profile, a solid member, or a tubular profile filled with another material such as an expandable foam.

Figure 8:
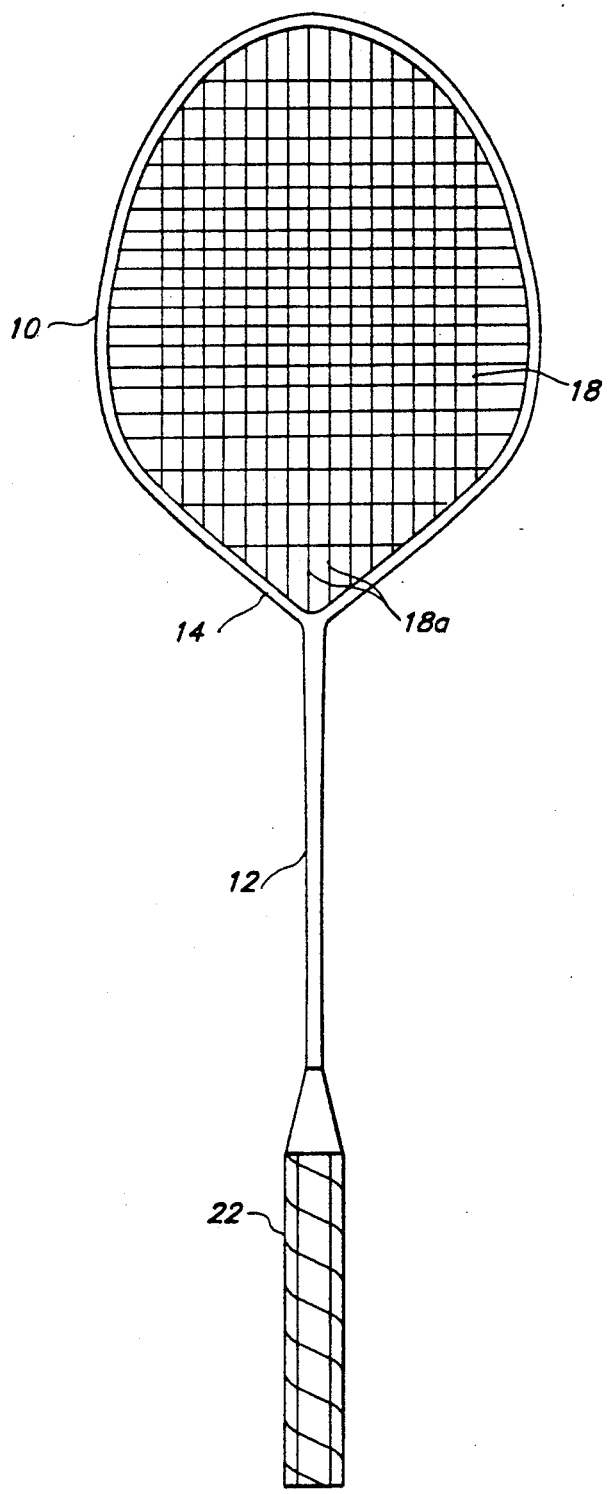
FIG. 8 is a plan view of a finished badminton racquet made with the frame of FIGS. 1–7.

Referring to FIG. 2, the head 10 includes a series of holes 16 for receiving strings 18 (FIG. 8), the outer holes 16 being disposed in a stringing groove 20 that extends approximately 180 degrees about the head 10.

The head 10 of the racquet varies in shape between the outer region and the Y-joint 14, as best shown in FIGS. 2–6. At the outer tip, shown in FIG. 3, the height h—h of the frame is at its greatest, and the width w—w is at its narrowest. As used herein, the height refers to the dimension perpendicular to the stringing plane, whereas the width is taken in a direction parallel to the stringing plane.

Figure 4:
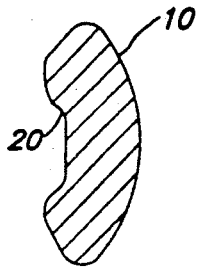
Figure 5:
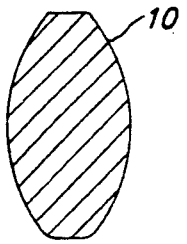
Figure 6:
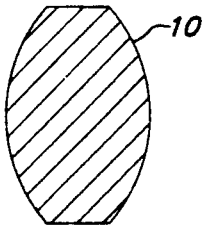

As shown in FIGS. 4, 5, and 6, the frame, moving in a direction toward the Y-joint 14, becomes progressively greater in width w—w and shorter in height h—h, i.e., becomes somewhat rounder. The decrease in height h—h can also be seen in FIG. 2, in the tapering region A-B.

Figure 7:
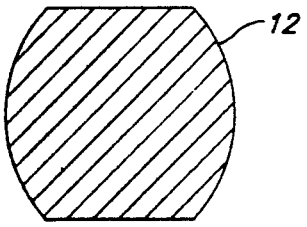

Shaft 12 also varies in dimension, as shown in FIGS. 1, 2, and 7. Just below the Y-joint 14, which is shown in FIG. 7, the shaft is relatively large in both width and height. In the region indicated as B-C in FIG. 2, the shaft 12 tapers to its narrowest width and height, which remains constant in the region C-D. In the region D-E the width and height again increase, with the portion between E and the end of the shaft having a constant dimension.

The exemplary racquet shown in FIGS. 1–8 has the following approximate dimensions. The frame has an overall length of 660 mm, a maximum width of 191 mm, and a stringing area length of 267 mm. In the region A-B, which is 278 mm in length, the height of the racquet tapers from 11 mm at the tip to 9 mm at the Y-joint 14, whereas the width increases from 4 mm at the tip to 5.8 mm at its cross section 6—6 (just above the joint 14). In region B-C, the height tapers from 9 mm to 7.5 mm, and the width decreases from 9.75 mm (at cross section 7—7) to 7.5 mm. In the region C-D, the height and width remain constant at 7.5 mm each with a round shape. In region D-E, the height and width each increases from 7.5 mm to 10 mm, where they remain constant to the end of the frame.

The stem 14*a* of the Y-joint is oriented along the racquet axis, and two arms 14*b* of the Y-joint diverge at an angle in the range of approximately 90–160 degrees relative to one another (45–80 degrees relative to the racquet axis). In FIG. 1, the arms diverge at approximately 120 degree angle relative to one another. The head 10 includes a pair of diverging portions 24 that extend approximately linearly for a distance, and then bend to extend generally parallel to the center axis before curving inwardly to the tip. The Y geometry thus permits the bottom of the head 10 to open rapidly, providing a large hitting area.

The head can be made of either a hollow or solid profile (as shown in FIGS. 3–6). Preferably, the head has a height in the range of 7 to 16 mm, and a width in the range of 4 to 9 mm. The shaft, which can also be hollow or solid (as shown in FIG. 7), has a height in the range of 5 to 16 mm and a width in the range of 4 to 12 mm. The shape of the shaft is preferably circular. Preferably, the racquet as strung has a weight in the range of 70 to 120 g.

The head 10, shaft 12, and Y-joint 14 may be formed either as one piece or as separate pieces. In order to make the frame of one piece, an elongated profile member such as a pre-preg layup of uncured resin, which may be a solid cylinder, a hollow tube, or a hollow tube with a filled core, is bent essentially into the shape of a question mark (?) and placed in a mold having the shape of FIG. 1. In the throat area, the profile is bent to form the stem and one arm of the Y-joint, and the free end of the curved head portion is positioned in contact with the partial joint to form the other arm of the Y-joint. Preferably, additional fiber wrapping is used to join the free end of the head portion to the joint (in a manner such as used to attach a bridge piece to a tennis racquet frame). Thereafter, the layup is co-cured by either compression molding (if solid) or internal inflation molding (if the pre-preg is a hollow tube), in a manner generally known.

In the case of a metal racquet, a tubular profile is bent into the shape of FIG. 1, and the free end of the curved head portion may be welded or otherwise structurally attached to complete the Y-joint.

If the head 10, shaft 12, and Y-joint are to be formed separately, the head 10 may be formed from a pre-preg layup of uncured resin, i.e., sheets of pre-preg resin either rolled to form a cylinder if the layup is solid or wrapped to form a tube if the layup is hollow. In the case of a hollow profile, the core may be filled with a known type of expandable foam (i.e., which expands upon heating).

The shaft 12 is formed in the same manner as the head or by mandrel wrapping. In the latter case, flexible sheets of uncured resin are wrapped about a mandrel, and thereafter wrapped with shrink tape. Alternatively, the shaft can be a shaped metal tube.

The Y-joint 14 may be formed by wrapping uncured resin sheets, by injection molding, or by insert molding (as described below).

The members 10, 12, 14 may then be joined by one of the following exemplary methods: (1) the three members are fitted together in a mold and cured; (2) the head and shaft are precured and are fitted into an uncured Y-joint, which is then cured in place; (3) the head and joint are precured together to form one piece, and a precured shaft is bonded by adhesive; (4) the head and shaft are precured; the ends of the head and shaft are inserted into a Y-joint mold, and plastic is injected to form the Y-joint and simultaneously bond to the head and shaft (insert molding).

As an alternative, the head and Y-joint, or the shaft and Y-joint, may be pre-formed as one piece. Also, other variations of the steps for joining the members are possible.

Once the frame is completed, the string holes 16 are drilled through the head sidewall and stringing groove 20. A handle 22, which may be any known type, is secured over the outer end of the shaft 12, and longitudinal and cross strings 18 are threaded through the string holes 16 in the customary manner.

The Y-joint geometry of the present invention provides a favorable transmission of impact force from the head 10 to the shaft 12. In addition, with the present geometry the center longitudinal strings, e.g., 18*a*, are longer than in the case of comparable T-joint frame, which means that the strings return more power.

The cross sectional geometry of the present frame also represents an improvement. In the outer region of the head, the frame has the greatest height and the lowest width/height ratio. This means that the racquet is stiffest in bending, and offers the least wind resistance at the tip. In the region of the Y-joint, where both bending and twisting stresses are transmitted, the profile is wider, offering better torsion characteristics.

In the case of racquets which also possess a kick shaft such as shaft 12, the stiffness of the shaft is preferably chosen such that the frame reacts like a golf club. During a swing, the head 10 undergoes a high acceleration rate. Due to the flex region C-D, the head 10 will initially lag the handle 22, and bend the shaft 12 due to its inertia. By choosing the proper stiffness for region C-D, which will vary depending upon the weight distribution in the racquet, the shaft 12 response can be selected so as to straighten, and thereby return the stored energy to the head, prior to impact with the shuttlecock.

The foregoing represents a preferred embodiment of the invention. Variations and modifications of the embodiment disclosed herein will be apparent to persons skilled in the art, without departing from the inventive principles disclosed herein. All such variations and modifications are intended to be within the scope of the invention, as defined in the following claims.

I claim:

1. A badminton racquet including a frame having a head, a shaft, and a Y-joint composed of a pair of arms and a stem that joins the head portion to the shaft portion, wherein the head includes an outer tip region, wherein the height of the head frame cross-section in a direction perpendicular to a string plane is greatest in the tip region and the width of the head frame cross-section within a plane of the stringing is smallest; wherein the height is greater than the width in the tip region; and wherein, in a direction toward the Y-joint, the height decreases and the width increases.

2. A badminton racquet as defined in claim 1, wherein the angle between the arms is in the range of approximately 90 to 160 degrees, and wherein the head includes a pair of opposed legs that extend outwardly from the Y-joint generally linearly for a distance.

3. A badminton racquet as defined in claim 2, wherein the opposed legs extend generally linearly approximately 70 percent of the total width of the head, and then bend to a region of maximum width.

4. A badminton racquet as defined in claim 1, wherein the height decreases linearly, as a function of position along the frame axis, from the tip region to the Y-joint.

5. A badminton racquet as defined in claim 4, wherein the width of the head increases, as a function of position along the frame axis, from the tip region to the Y-joint.

6. A badminton racquet as defined in claim 1, comprising a handle mounted on an end region of the shaft, wherein the shaft includes a relatively flexible region lying between the handle and the Y-joint.

7. A badminton racquet as defined in claim 6, wherein the shaft has a height which is smallest in the flexible region, and which increases toward the handle and Y-joint.

8. A badminton racquet as defined in claim 1, wherein the height increases and the width decreases continuously from the tip region to the Y-joint.

* * * * *